US005460089A

United States Patent [19]

Kennedy

[11] Patent Number: 5,460,089

[45] Date of Patent: Oct. 24, 1995

[54] FLATBED CREDIT CARD IMPRINTER

[75] Inventor: Randall J. Kennedy, Kitchener, Canada

[73] Assignee: NBS Technologies, Inc., Ontario, Canada

[21] Appl. No.: 305,714

[22] Filed: Sep. 14, 1994

[51] Int. Cl.[6] ..... B41F 5/04

[52] U.S. Cl. ..... 101/269; 101/45; 101/56; 101/485

[58] Field of Search ..... 101/269–274, 101/45, 56, 407.1, 474, 483, 485, 479

[56] References Cited

U.S. PATENT DOCUMENTS

| | | | |
|---|---|---|---|
| 4,270,453 | 6/1981 | Strohschneider | 101/269 |
| 4,281,596 | 8/1981 | Bowen | 101/269 |
| 4,401,029 | 8/1983 | Barbour | 101/269 |
| 4,628,812 | 12/1986 | Fisk | 101/269 X |
| 4,742,770 | 5/1988 | Weickert et al. | 101/269 |
| 5,062,361 | 11/1991 | Kabelsky | 101/269 |
| 5,193,459 | 3/1993 | Barbour | 101/269 |

*Primary Examiner*—Chris A. Bennett
*Attorney, Agent, or Firm*—Antonelli, Terry, Stout & Kraus

[57] ABSTRACT

An imprinter (10) for imprinting a formset (12) with embossed data from a card (14) and a plate (16) in accordance with the invention includes a flatbed (20) having a top surface (22) on which the card and the plate are held below the formset during imprinting; a movable carriage (24) having at least one rolling platen (48 and 50) with the at least one rolling platen imprinting the embossed data during movement along the flatbed; and a single piece skirt (26) having a periphery (28) which extends peripherally outside the flatbed and which is attached to the flatbed to from a unitary structure of the flatbed and the skirt with the skirt having a plurality of projections (30 and 32) extending inward onto the top surface of the flatbed with the projections defining a card receiving surface area (34) on the top surface of the flatbed for holding the card during imprinting and a formset receiving area (36) on the top surface of the flatbed for holding the formset during imprinting.

30 Claims, 9 Drawing Sheets

FLATBED CREDIT CARD IMPRINTER

CROSS-REFERENCE TO RELATED APPLICATIONS

Reference is made to copending application Ser. No. 08/053,669, filed Apr. 29, 1993, entitled "Credit Card Imprinter" and U.S. Ser. No. 08/210,951, filed Mar. 21, 1994, entitled "Credit Card Imprinter" which applications are incorporated herein by reference in their entirety.

TECHNICAL FIELD

The present invention relates to imprinters for imprinting formsets such as credit transaction receipts with embossed data from a card and a plate and further a method of assembling an imprinter which imprints a formset with embossed data from the card and the plate.

BACKGROUND ART

Data recorders are widely used throughout the world for making records of transactions such as credit card transactions and entry into hospitals. Data recorders transfer account information contained on cards, such as plastic credit cards and information identifying a merchant or organization, such as a hospital, onto a multiple sheet formset to create a record of a transaction. Typically, the plastic card is disposed onto the top surface of a flatbed at a predetermined location so as to transfer the account information of the plastic card to the correct location on the formset. A movable carriage containing one or more rolling platens is manually moved or moved under the power of an electric motor across the top surface of the formset to provide sufficient pressure between the peripheral surface of the at least one rolling platen and the underlying embossed characters on the plastic card and plate identifying the organization making the imprint to transfer embossed data to the formset.

Prior art credit card imprinters are typically manufactured from a number of different assemblies which must be assembled to produce the credit card imprinter. Among the assemblies which must be assembled together to form an imprinter are a movable carriage which runs along rails which are located on the outside peripheral edge of the flatbed which receives the formset, credit card and station plate, a flatbed, and card and formset positioning devices which are attached to the top surface of the flatbed for locating precisely the position of the card and the formset for making the imprint.

The overall cost of manufacturing imprinters having the aforementioned multipart assembly is increased because of the increased labor, time and number of parts required to assemble the imprinter. Because of the fact that imprinters are widely used and purchased by merchants in an extremely cost competitive market, a higher manufacturing cost places the higher cost manufacturer of the imprinter at a large disadvantage to lower cost competition. It is highly advantageous for the manufacturer of imprinters to reduce the cost of manufacturing of imprinters in order to meet the competitive situation which exists in the market place today.

U.S. Pat. Nos. 4,270,453 and 4,281,596 disclose an imprinter which is stated to be economically manufactured which has an extruded metallic base and a molded print bed made from a plastic material. However, the disclosed imprinter has a four part assemblage with two end caps and further a plastic insert having a configuration as illustrated in, for example, FIG. 12 of the '453 and '596 patents.

DISCLOSURE OF INVENTION

The present invention is an imprinter for imprinting a formset with embossed data from a card and a plate and further, a method of assembling an imprinter, which imprints a formset with embossed data from a card and a plate. The imprinter has a flatbed with a top surface supporting the card, plate and formset and a movable carriage which rolls along the flatbed during imprinting of the formset with embossed data. The present invention is less expensive to assemble and manufacture and has fewer main assemblies than the prior art. Cost savings achieved by the present invention as a consequence of the overall imprinter assembly being made of three main assemblies which are a one piece carriage with rollers which is attached to a one piece metallic flatbed which assemblies are attached to a single piece skirt which is preferably plastic having a periphery which extends peripherally outside the flatbed and which is attached to the flatbed to form a unitary structure. The skirt has a plurality of projections extending inward from the periphery onto the top surface of the flatbed with the projections defining a card receiving surface area on the top surface of the flatbed for holding the card during imprinting and a formset receiving area on the top surface of the flatbed for holding the formset during imprinting.

The single piece skirt is attached to the flatbed preferably by deforming a plurality of spigots which project orthogonally from the projections by deforming an end of each of the spigots which extends through a plurality of spigot apertures cut through the flatbed from the top surface to the bottom surface. The ends of the spigots are deformed to a dimension larger than the largest dimension of a cross section of the spigot aperture through which each spigot projects and contact a bottom surface of the flatbed to effectively attach the skirt to the flatbed while, at the same time, defining the card and formset receiving areas. As a result, the dimensions and location of the card receiving area and formset receiving area are defined on the flatbed by the molding of the skirt and the drilling of the spigot apertures in the flatbed.

Preferably, the two piece assembly of the carriage and the flatbed are attached to the skirt by the use of a double action press which performs a sequence of steps. The skirt is set on top of the two piece assembly of the carriage and flatbed. This assembly is then set in the double action press which first presses the spigots of the skirt into the flatbed through the spigot apertures so that the spigots project through to the bottom surface of the flatbed. When the skirt is bottomed on the top surface of the flatbed, a set of punches is moved into contact with an end of each of the spigots which extends through the plurality of spigot apertures cut through the flatbed to swage the ends to produce a deformed dimension larger than a largest dimension of a cross section of the spigot aperture through which each spigot projects which contacts the bottom surface of the flatbed to create the unitary assembly of the single piece skirt attached to the two piece assembly of the carriage and the flatbed.

The aforementioned assembly lowers the cost of the imprinter as a consequence of the simplification of the assembly process. The assembly requires no additional hardware or components which, in the prior art, was required because of additional main parts and manufacturing operations required to attach the main imprinter parts to the flatbed defining the card receiving surface area on the top surface of the flatbed for holding the card during imprinting and the formset receiving area on the top surface of the flatbed for holding the formset during imprinting. While the assembly process is simplified, fewer main parts are required and the cost of manufacturing is lower with respect to the prior art, the overall functionality of the imprinter is identical to the prior art.

An imprinter for use imprinting a formset with embossed data from a card and a plate in accordance with the invention includes a flatbed, which preferably is rectangular, having a top surface for supporting the card, plate and formset during imprinting with the formset being disposed above the card and plate during imprinting; a movable carriage having at least one rolling platen with the at least one rolling platen imprinting the embossed data during movement of the at least one platen along the flatbed; and a single piece skirt, which is preferably made from a molded plastic, having a periphery which extends outside the flatbed which is attached to the flatbed to form a unitary structure of the flatbed and the skirt with the skirt having a plurality of projections extending inward onto the top surface of the flatbed with the projections defining a card receiving surface area on the top surface of the flatbed for holding the card during imprinting and a formset receiving area on the top surface of the flatbed for holding the formset during imprinting. The invention further includes four posts formed in the single piece skirt which respectively receive individual feet to support the imprinter on a flat surface during imprinting, the four posts being located respectively at corners of the flatbed with opposed ends of the skirt stopping travel the carriage during movement along the flatbed to the opposed ends. The skirt has a plurality of spigots which project through spigot apertures extending through the flatbed from the top surface to a bottom surface and the skirt is attached to the flatbed by a deformed end of each of the spigots contacting the bottom surface with the deformed end having a deformed dimension larger than a largest dimension of a cross section of the aperture through which the spigot projects. A first pair of projections extend inward over the top surface of the flatbed from opposed ends of the skirt with ends of the first pair of projections being separated on the top surface of the flatbed by a length of the card; and a second pair of projections extend inward over the top surface of the flatbed from the opposed ends of the skirt with ends of the second pair of projections being separated on the top surface of the flatbed by a length of the formset. The flatbed has an aperture which extends from the top surface to the bottom surface and which receives a mechanism carried by one of the first pair of projections which prevents the carriage from being moved over the card receiving surface area when a card is not positioned on the top surface of the card receiving area. A first pair of the projections extend inward over the top surface of the flatbed from opposed ends of the skirt with ends of the first pair of projections being separated on the top surface of the flatbed by a length of the card; and a second pair of projections extend inward over the top surface of the flatbed from the opposed ends of the skirt with ends of the second pair of projections being separated on the top surface of the flatbed by a length of the formset. The carriage has two sets of wheels for rotatably supporting the carriage for movement along the flatbed, each set of wheels having an upper wheel which rolls in contact with one of a pair of spaced apart rails respectively located along opposed sides of the flatbed with the rails extending above the top surface of the flatbed and a pair of lower wheels which ride on a bottom rail of the flatbed; a pair of opposed and spaced apart sides of the skirt respectively being spaced from an outside surface of a pair of downwardly extending sides of the carriage with the spaced apart sides of the skirt and opposed sides of the flatbed defining a pair of slots along which the downwardly extending sides of the carriage respectively carrying the first and second sets of wheels move during movement of the carriage along the flatbed; and the projections project inward from the skirt in a direction parallel to the pair of rails.

A method of assembling an imprinter, which imprints a formset with embossed data from a card and a plate, having a flatbed, which is preferably rectangular, with a top surface of the flatbed supporting the card, plate and formset and a movable carriage which rolls along the flatbed during imprinting of the form set with the embossed data in accordance with the invention includes forming a single piece skirt, which is preferably plastic, having an inside periphery for receiving the flatbed with the skirt having a plurality of projections extending inwardly from the skirt over the flatbed with a first pair of projections having ends separated by a length of the card and a second pair of projections having ends separated by a length of the formset; and attaching the skirt to the flatbed with the projections extending over the flatbed to form a unitary structure. The skirt has a plurality of spigots which project orthogonally from the projections and the skirt is attached to the flatbed by deforming an end of each of the spigots which extends through a plurality of spigot apertures cut through the flatbed from the top surface to a bottom surface to a deformed dimension larger than a largest dimension of a cross section of the spigot aperture through which each spigot projects with the deformed dimension contacting the bottom surface. The method further includes cutting an aperture through the flatbed from the top surface to the bottom surface which receives a mechanism carried by one of the first pair of projections which prevents the card from being moved over a card receiving area of the top surface of the flatbed extending between ends of the first pair of projections; and wherein the attaching the skirt to the flatbed to form the unitary structure positions the mechanism in the aperture through the flatbed which receives the mechanism. Each projection has a spigot and the end of each spigot is deformed.

BEST MODE FOR CARRYING OUT THE INVENTION

Figure 1:
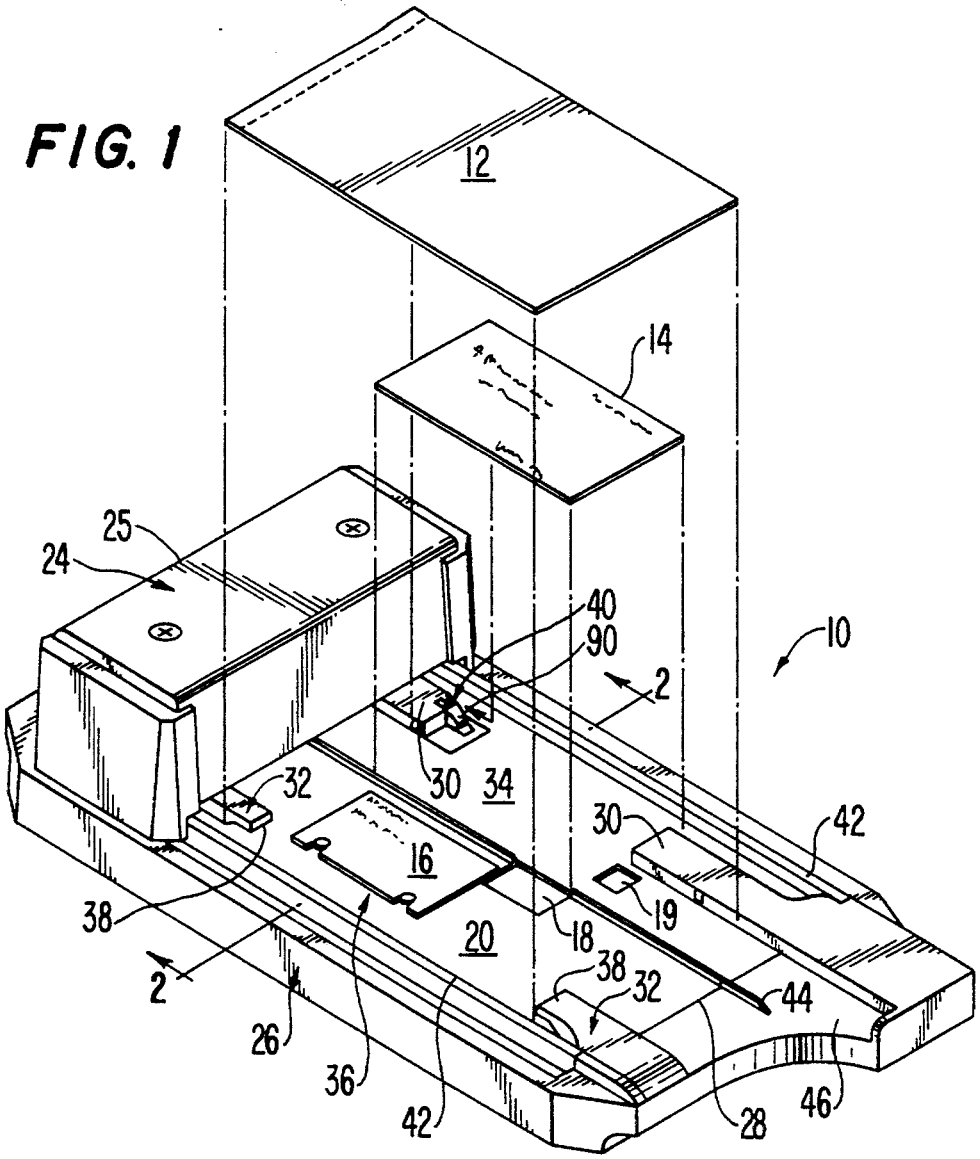
FIG. 1 is a perspective view of an imprinter for imprinting a formset with data from an embossed card and a plate in accordance with the present invention.

FIG. 1 illustrates a perspective view of an imprinter 10 for imprinting a formset 12 which, at the time of imprinting, is positioned on top of a card 14, which is illustrated in FIG. 1 as a credit card, and an identifying plate 16 which identifies the organization associated with the imprinter 10 and which is illustrated as a merchant's station plate. The card 14 and plate 16 carry embossed data, usually in the form of characters, which are transferred to the formset upon imprinting when the carriage 24 is moved over the flatbed 20 in accordance with conventional operation of an imprinter. The preferred form of the imprinter is the design known as the double roller, double stroke design in which the carriage 24 carries two rolling platens, as discussed below, which respectively imprint the embossed characters from the card 14 by moving the carriage in a first direction and the embossed characters from the station plate 16 in a second direction opposite the first direction. Thus, completion of imprinting requires a forward and reverse stroke. However, the present invention is not limited to carriages with a double rolling platen configuration. Like reference numerals are used to identify like parts throughout the drawings. Aperture 18 receives a dater (not illustrated) for imprinting date information with the imprinter as is conventionally used in the imprinting industry. Aperture 19 permits a card 14 to be removed from the card receiving area 34 from underneath the imprinter such as with a finger of an operator of the imprinter.

The imprinter 10 is comprised of three main parts which are flatbed 20 which is preferably made from an extruded piece of aluminum which has a top surface 22 on which the card 14, station plate 16 and dater are positioned, a movable carriage 24 which is described in detail below in conjunction with FIGS. 2, 3, 4 and 7 and which has a preferred construction as described in pending patent application Ser. Nos. 08/053,669 and 08/210,951, and a single piece skirt 26 having a periphery which extends outside the rectangular flatbed which is attached to the flatbed to form a unitary structure of the flatbed, carriage and the skirt. The skirt 26 has a first pair of projections 30 and a second pair of projections 32 each of which extend inward from the inside periphery 28 of the skirt so that the projections extend over the top surface 22 of the flatbed 20. The first pair of projections 30 define the card receiving area 34 on the surface 22 of the flatbed 20 which receives the card 14 as illustrated in FIG. 1. The second pair of projections 32 define a formset receiving area 36 on the top surface 22 of the flatbed 20 of the formset 12 as illustrated in FIG. 1. As is illustrated, the formset 12 is positioned underneath the overhanging lip 38 of the second pair of projections 32 and against the rail 42 in order to securely position the formset during the movements of the carriage 24 in first and second imprinting directions during which the image of the characters carried by the card 14 and the plate 16 respectively are transferred to the formset 12.

One of the first pair of projections 30 has a mechanism 40 known in the art as a "no card no print" mechanism which prevents the carriage 24 from being moved over the card receiving surface area 34 when the card 14 is not positioned on the top surface 22 of the flatbed 20 at the card receiving area 34. The operation of the mechanism 40 is described in detail below in conjunction with FIGS. 3 and 4 and the structure of the mechanism is described in conjunction below with FIGS. 5 and 6.

The top surface 22 of the flatbed 20 has a pair of outside upward extending vertical rails 42 which respectively function to position the outside longitudinal edges of the formset 12 and the card 14 on the top surface 22 of the flatbed 20. The top wheels 74 of the carriage 24 illustrated in FIG. 2 roll on the top surface of the rails 42. A middle upward projection 44 extends vertically upward from the top surface 22 of the flatbed 20 for the purpose of locating the inner longitudinal edge of the credit card 14. It should be noted that the rails 42 and middle upward projection 44 also extend upward from the top surface 46 of the skirt 26 which is in the same plane as the top surface 22 of the flatbed 20. The extension of the rails 42 and middle upward projection 44 onto the top surface 46 of the skirt 26 is made for aesthetic purposes.

Figure 2:
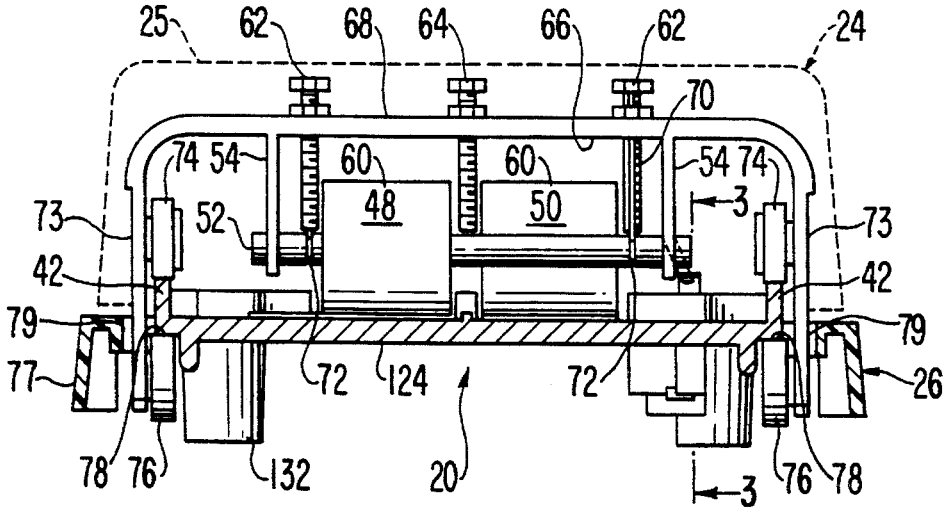
FIG. 2 is a sectional view of FIG. 1 taken along section lines 2—2.

FIG. 2 is a sectional view of FIG. 1 taken along section lines 2—2 which illustrates the carriage cover 25 removed from the carriage 24. The movable carriage 24 is formed from extruded metal, which is preferably aluminum, which is inexpensive to form as a consequence of the extrusion process being much more rapidly performed for forming each blank used to make a carriage than the corresponding thermoplastic molding operation of the prior art. Metal forming operations for producing a carriage are discussed in detail in the above-referenced application Ser. Nos. 08/053,669 and 08/210,951. The system for suspending the first rolling platen 48 and the second rolling platen 50 is of low cost to manufacture, is easily adjusted to set the rolling platens to a preset height necessary to produce a high quality OCR imprint of the embossed data (characters, etc.) on the card 14 and the station plate 16 and has a small number of parts. The rolling platens 48 and 50 are respectively attached to an axle 52. The carriage 24 has a pair of downwardly extending members 54 which are formed preferably by the extrusion process.

Figure 3:
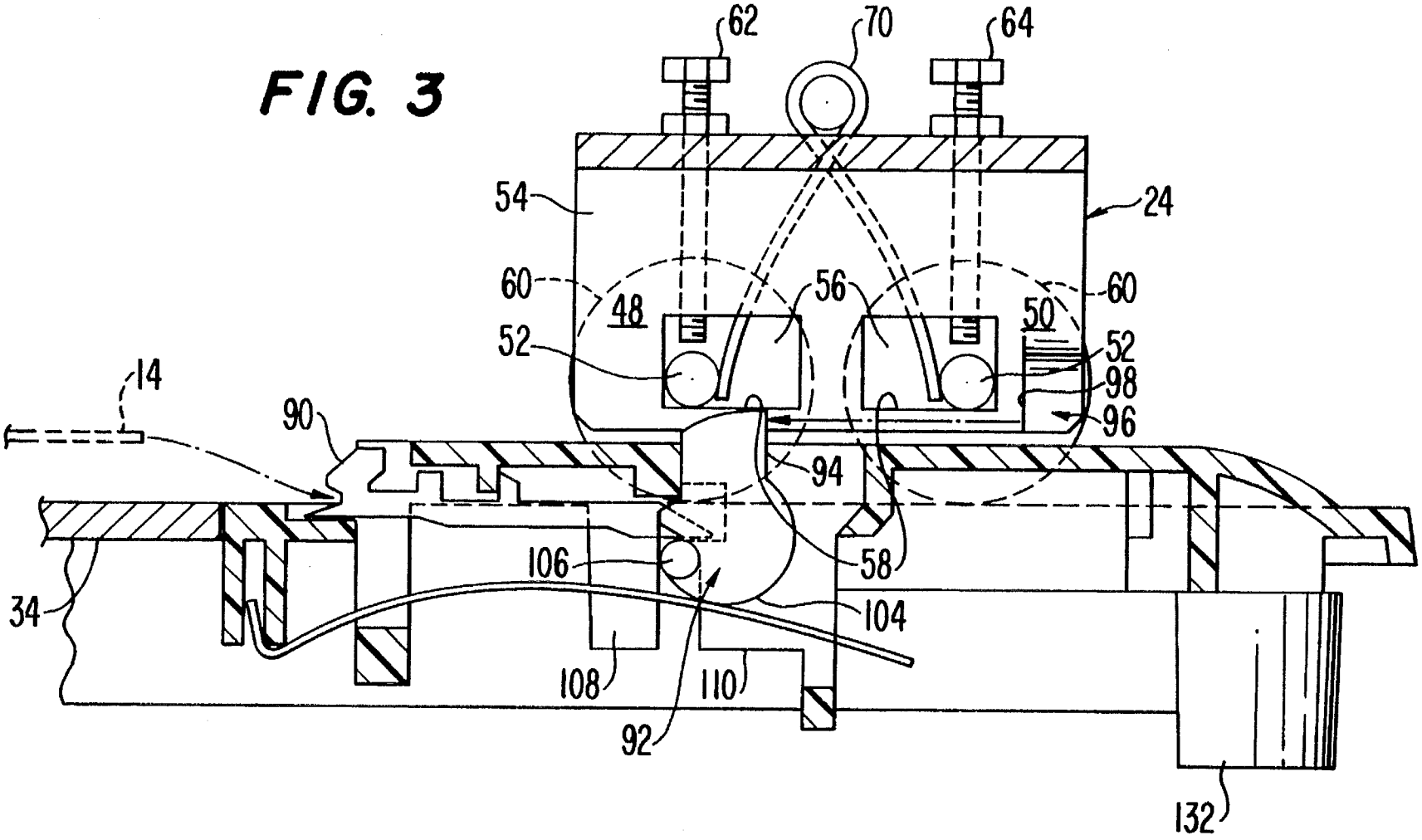
FIG. 3 illustrates a sectional view of a mechanism carried by one of a first pair of projections of the skirt which prevents a carriage from being moved over the card receiving surface area.
Figure 4:
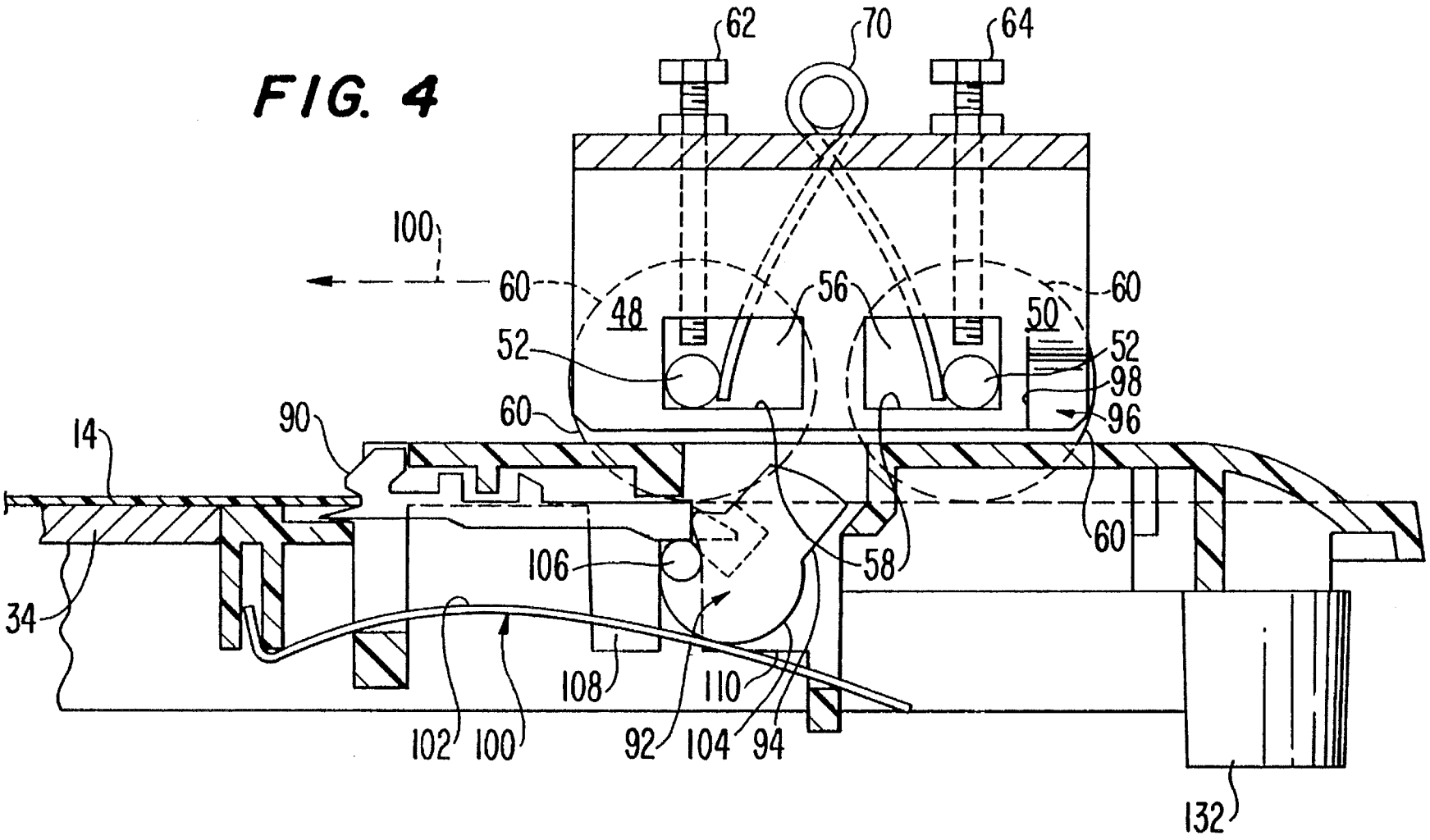
FIG. 4 illustrates a view of the mechanism carried by one of the first pair of projections of the skirt in a position which permits the carriage to be moved over the card receiving area when a card is in position on the top surface of a flatbed at the card receiving area.

First and second pairs of openings 56, illustrated in FIGS. 3 and 4, respectively receive the axles 52 attached to the first and second rolling platens 48 and 50. The openings 56 have a length and a height which is greater than the diameter of the axle 52 which permits the axles to roll along surface 58 during movement of the carriage 24 in first and second directions to respectively imprint characters of the card 14 and station plate 16 so that the axles are free to roll between first and second ends of the openings 56 and further are free to move orthogonally upward from the flatbed 20 when the outside periphery 60 of the first and second rolling platens 48 and 50 contacts the raised edge of the credit card 14 and the raised edge of the station plate 16 in the first and second directions of travel of the movable carriage 24 for respectively imprinting the characters of the credit card and station plate. The height of the openings 56 is sufficient to permit the axles 52 to move freely upward without application of force from the outside periphery 60 of the rolling platens 48 and 50 to the formset 12 and card 14 and formset 16 to cause an imprint. Thus, when the carriage 24 is moved in a direction that one of the first and second rolling platens 48 and 50 does not imprint, contact of the outside periphery 60 of one of the rolling platens 48 and 50 causes the axle 52 to lift freely orthogonally upward away from the surface 58 of the openings 56.

First and second pairs of stops 62 and 64, which are of adjustable length relative to the bottom surface 66 of the center section 68 of the carriage 24, determine the vertical position of the rolling platens 48 and 50 relative to the flatbed 20. The correct vertical positioning of the platens 48 and 50 is important in producing a high quality OCR readable image. The first pair of stops 62 engage the axle 52 during imprinting at a position displaced outboard from a first side of the first rolling platen 48 and displaced outboard from a second side of the first rolling platen 48 which is opposite the first side. Similarly, the second pair of stops 64 respectively engage the platen axle 52 during imprinting at a position axially displaced outboard from a first side and outboard from a second side of the rolling platen opposed to the first side. The first pair of openings 56 and the second pair of openings 56 extend in the first and second directions of travel of the carriage 24 along a length that is greater than the diameter of the axle so that the axle of the first rolling platen 48 is free to roll between first and second ends of the first pair of openings in the first and second directions during movement of the carriage in the first and second directions. The first and second pairs of stops 62 and 64 are respectively preferably threaded in the carriage 24 to engage the platen axle 52 of the first and second rolling platens 48 and 50 at the end of the first and second pairs of openings during imprinting by the first and second rolling platens. A pair of hair springs 70 extends downward through the center section 68 of the carriage which have ends which engage a recess 72 cut in each of the platen axles 52 adjacent and inboard of the downward extending members 54 to apply a spring bias to maintain separation of the axles. The hair springs 70 tend to quiet down the operation of the imprinter to prevent a sensation that the rolling platens 48 and 50 rattle in the carriage during movement.

The carriage 24 has opposed downwardly extending sides 73 to which are attached an upper wheel 74 and a pair of lower wheels 76 providing a three point suspension which is in rolling contact with the upward rails 42 and lower rails 78. The three point suspension performs the same overall function as in the prior art carriage suspension. As is apparent from FIG. 2, the skirt 26 has a pair of opposed and spaced apart sides 77 which are respectively spaced from an outside surface of one of the downwardly extending sides 72 to define a pair of parallel slots 79. The downwardly extending sides 73 of the carriage 24 move along the slots 79 during movement of the carriage in the first and second directions along the flatbed 20.

FIGS. 3 and 4 illustrate the operation of the mechanism 40 for preventing the movement of the carriage 24 across the top surface 22 of the flatbed 20 when a card 14 is not positioned on top of the card receiving area 34. As illustrated in FIG. 3 when the card 14 is not in position on the card receiving area 34, the member 90 has not rotated the rotatable stop 92 from the vertical position, as illustrated, to a position where the vertically extending edge 94 will clear the outwardly projecting section 96 of the downwardly extending member 54 thereby preventing the carriage 24 from moving to the left past a point of engagement of the vertical edge 98 of the outwardly extending section 96 with the vertically extending edge 94 of the downwardly extending member 54. This feature, as stated above, is known as a "no card no print" feature. As viewed with respect to FIG. 1, the carriage 24 is prevented from moving to the right over the card 14 and station plate 16. As illustrated in FIG. 4 where the card 14 has been placed on the top surface of the card receiving area 34, the member 90 has been moved to the right causing the rotatable stop 92 to rotate clockwise approximately 45° to permit clearance of the edge 98 of the outward projection 96 from the edge 94 of the rotatable stop to permit imprinting to occur. As long as the card is in position at the card receiving area 34, as illustrated in FIG. 4, the carriage 24 may be moved to the left, as illustrated by the arrow 100, and then back to the right in the position illustrated in FIG. 3 to permit imprinting of the characters onto formset 16 from the card 14 station plate 16 and dater positioned in aperture 18. The hair springs 70, as stated above, quiet operation by preventing the rolling platens 48 and 50 from rolling loosely over surface 58.

Figure 5:
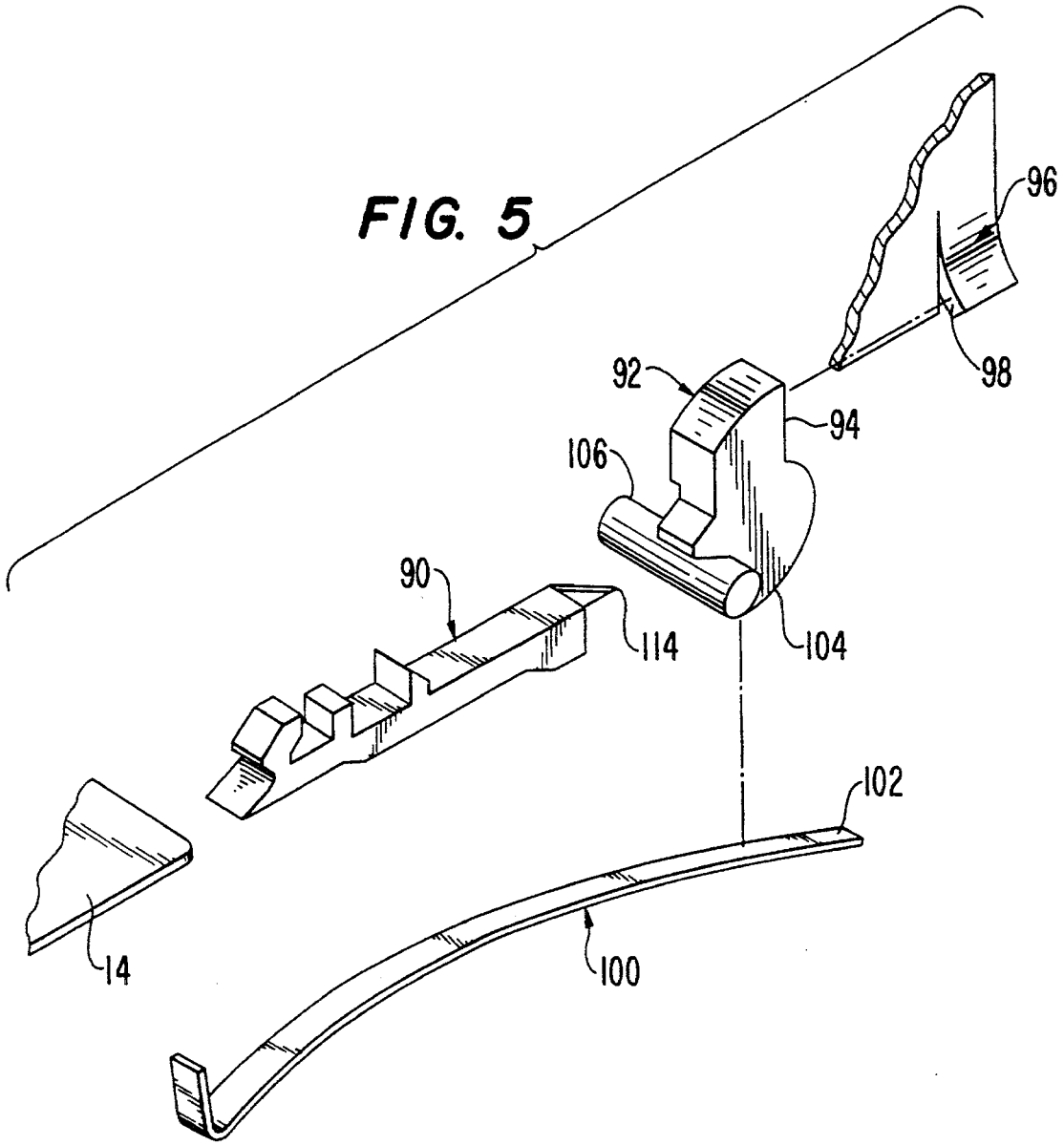
FIG. 5 is an exploded view of the mechanism for preventing the carriage from being moved over the card receiving area illustrated in FIGS. 3 and 4.
Figure 6:
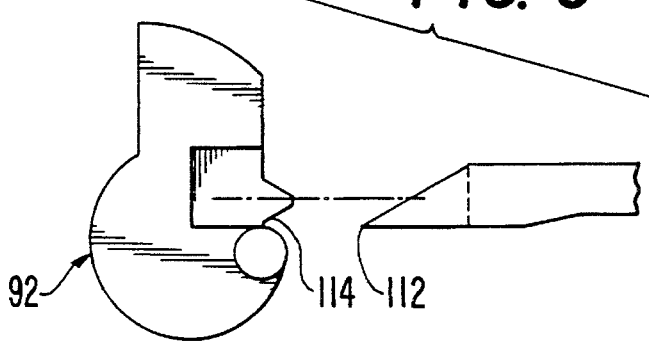
FIG. 6 illustrates an enlarged view of part of the mechanism of FIG. 5 which illustrates how movable parts of the mechanism interact.

FIGS. 5 and 6 illustrate, respectively, an exploded view of the mechanism 40 which prevents an imprint from being made when a card 14 is not positioned on the card receiving area 34 and an exploded view of the coupling of the member 90 within the rotatable stop 92. With respect to FIGS. 3–5, spring 100 biases the rotatable member 92 vertically upward such that a top surface 102 of the spring 100 rides on the curved surface 104 of the rotatable stop 92 which forces the axle 106 vertically upward within the slot defined by the downwardly projecting members 108 and 110 illustrated in FIGS. 3 and 4. As may be seen in FIG. 6, the point 112 of member 90 fits within a notch 114 of the rotatable member 92 so that longitudinal movement of the member 90, to the right in FIG. 4, caused by the card 14 produces the clockwise rotation of the rotatable stop 92 without the tip 112 coming from engagement with the notch 114. The spring 100 by vertically biasing the axle 106 vertically upward within the notch between the members 108 and 110 insures that a positive engagement always occurs between the tip 112 and the notch 114.

Figure 7:
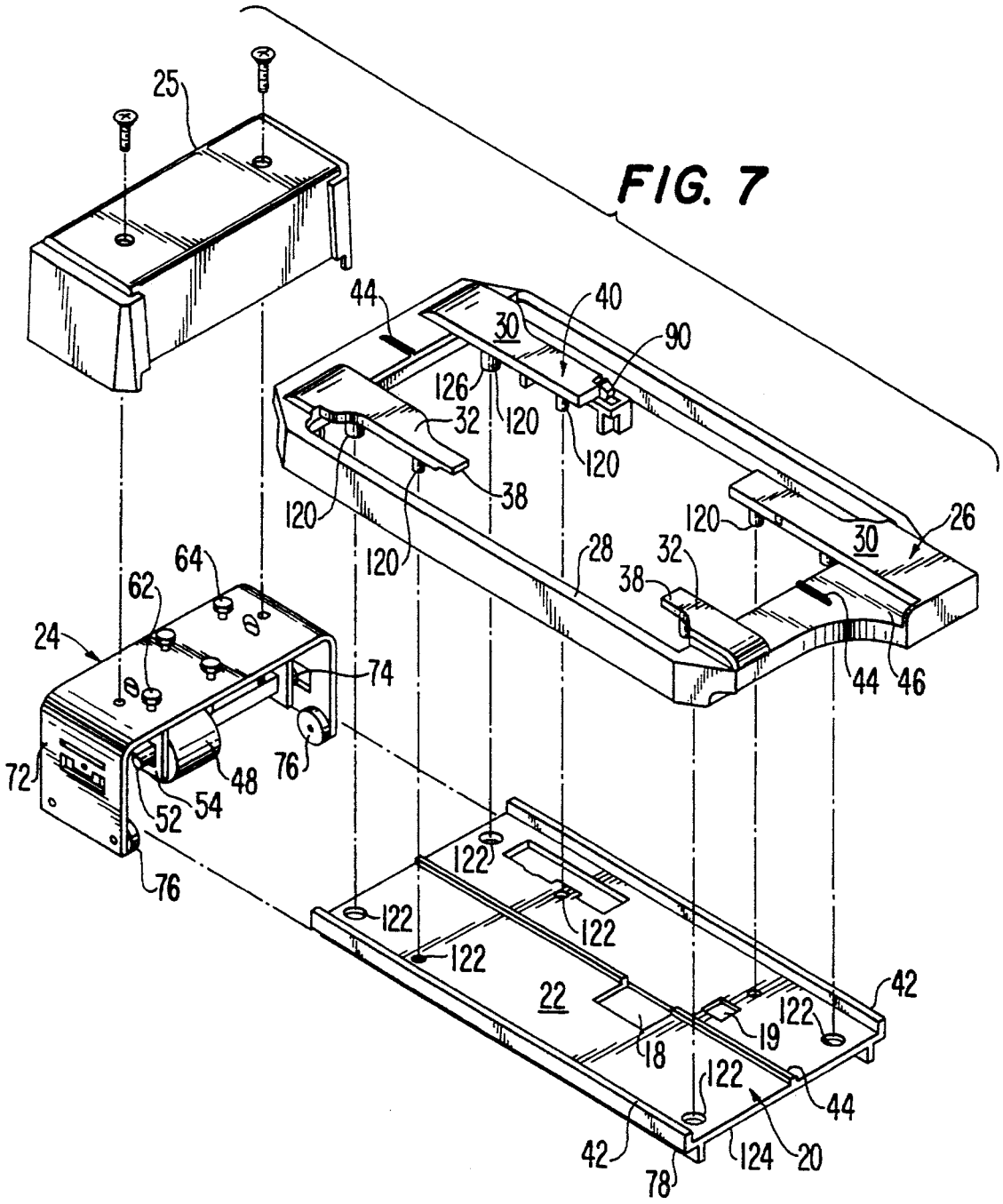
FIG. 7 illustrates an exploded view of the three main parts of the assembly of an imprinter in accordance with the invention.

FIG. 7 illustrates an exploded view of the three major assemblies of the present invention which are the flatbed 20, carriage 24 and skirt 26. Attachment of the carriage 24 to the flatbed 20 is produced by positioning the rollers 74, 76 in rolling engagement with the upper and lower rails 42 and 78 to produce a two piece assembly. Thereafter, the skirt 26, which is preferably made from a molded plastic, is moved toward the flatbed 20 such that the spigots 120 project through spigot apertures 122 from the top surface 22 of the flatbed 20 to a bottom surface 124. The skirt apertures 122 may be made by drilling the metallic flatbed 20. Thereafter, the skirt is attached to the flatbed by deforming ends 126 of each of the spigots 120 to cause contacting of the bottom surface 124 with the deformed swaged end 126 of a spigot, as illustrated in detail in FIG. 12. The deformed end 126 has a deformed dimension larger than a largest dimension of the cross section of the aperture 122 through which a corresponding spigot 120 projects.

Figure 12:
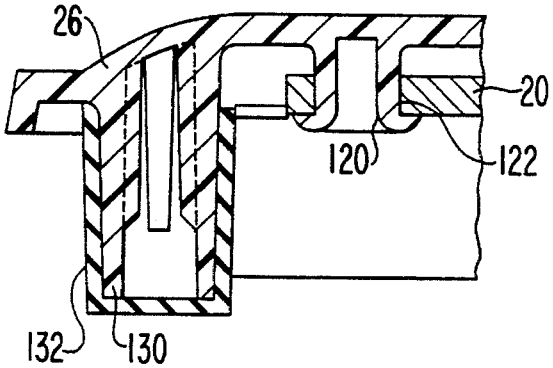
FIG. 12 illustrates an enlarged view of the swaged spigots of the skirt which attach the flatbed to the single piece skirt.
Figure 13:
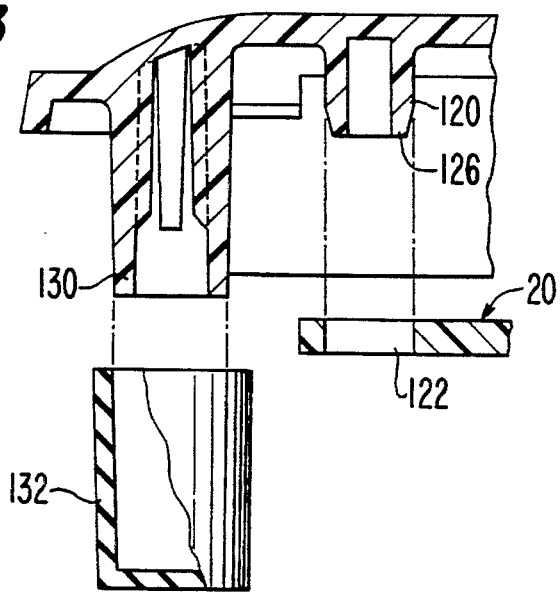
FIG. 13 illustrates an exploded view of the assembly of FIG. 12 prior to swaging.

A preferred way of attaching the flatbed 20 to the skirt 26 is by use of a double action press (not illustrated). The press positions the spigots 120 through the spigot apertures 122 of the flatbed 20. After the skirt 26 is bottomed onto the top surface 22 of the flatbed 20, a set of punches contacts each of the ends 126 of the spigots 120 and swages the bottom of the spigots open by inelastic deformation, as illustrated in FIG. 12, to permanently attach the skirt to the flatbed by contact of the deformed end of the spigot with the bottom surface of the flatbed. Thereafter, posts 130 of the skirt 26 receive mounting feet 132 as illustrated in FIGS. 12 and 13.

The overall simplicity of the aforementioned three piece assembly reduces the cost of the imprinter. The aforementioned sequence which is performed by the double action press only takes a few seconds and further requires no hardware or additional components. The prior art requires additional attachment mechanisms because the prior art structures performing the functions of the pairs of projections 30 and 32 are connected as distinct elements to the flatbed which are not part of a one piece skirt. Once the carriage 24 is positioned into rolling contact with the upper and the lower rails 42 and 78, the single operation of swaging the ends 126 of the spigots 120 completes the assembly process which reduces the overall assembly of the final imprinter to a minimum number of steps involving a minimum number of major assemblies which results in a cost savings lowering the overall cost of the imprinter when compared to the prior art manufacturing processes.

Figure 8:
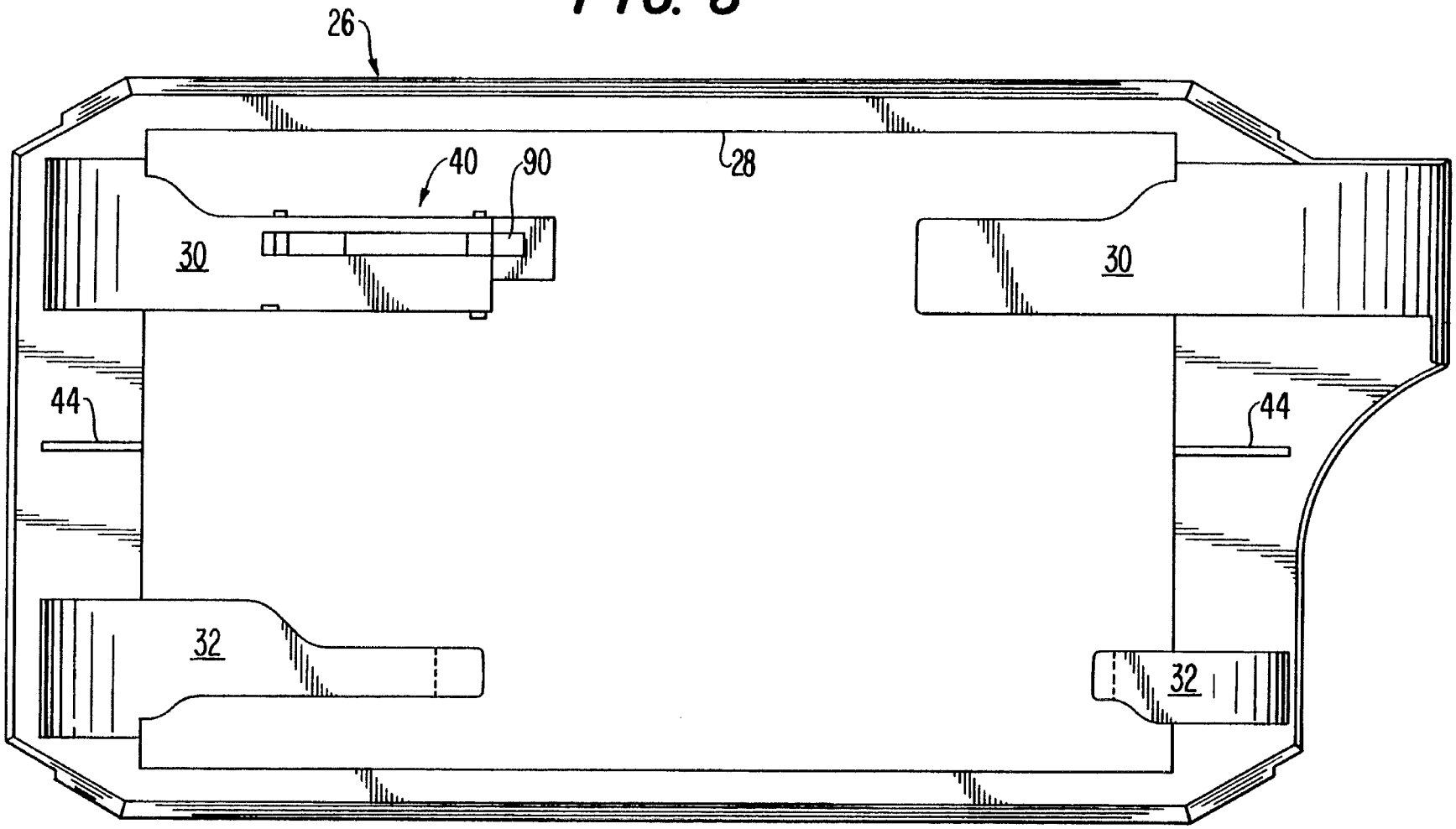
FIG. 8 illustrates a top plan view of the single piece skirt.

FIG. 8 illustrates a top plan view of the skirt 26. As is illustrated in FIG. 8, the left hand one of the first pair of projections 30 carries the mechanism 40 for preventing the carriage 24 from being moved over the card receiving area 34 when a card 14 is not positioned on the top surface 22 of the flatbed 20 at the card receiving area. It should be noted that, preferably, the skirt 26 is a one-piece mold made from plastic. By making the molded skirt 26, which includes the projections 30 and 32, which define the card receiving area 34 and formset receiving area 36 and further carry the mechanism 40 for preventing imprinting when a card 14 is not in position upon attachment of the skirt 26 to the flatbed 20, numerous functional aspects of the imprinter are finally defined spatially on the flatbed 20 which reduces costs.

Figure 9:
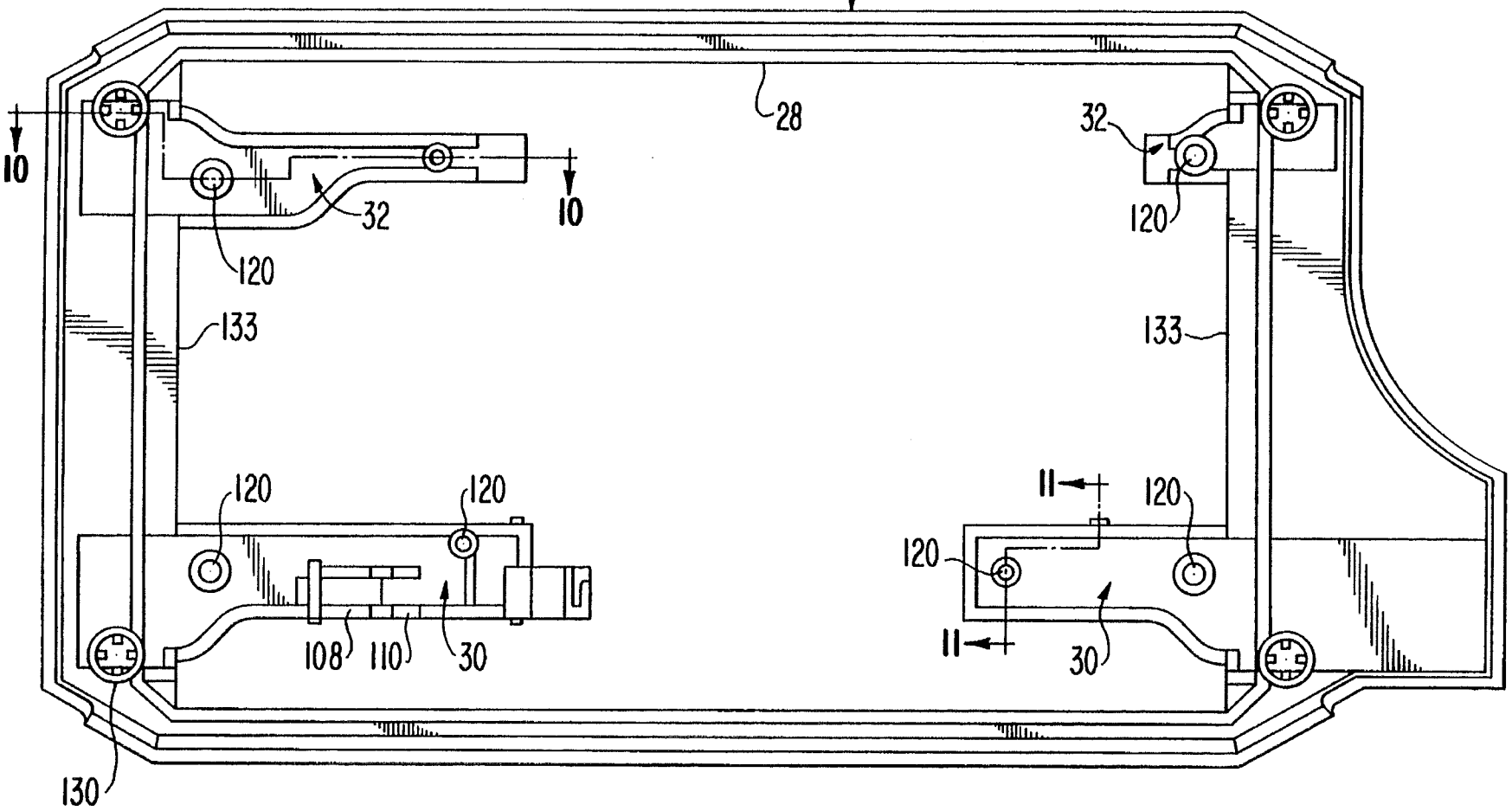
FIG. 9 illustrates a bottom plan view of the single piece skirt.

FIG. 9 illustrates a bottom plan view of the skirt 26. Each of the pairs of projections 30 and 32 have at least one spigot 120 which is deformed, as illustrated in FIG. 12, to complete the attachment process of the skirt 26 to the flatbed 20.

Figure 10:
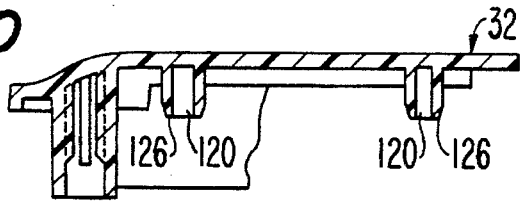
FIG. 10 illustrates a sectional view of FIG. 9 taken along section lines 10—10.

FIG. 10 illustrates a sectional view of projection 32 taken along section line 10—10 in FIG. 9. The spigots 120 and posts 130 which receive the feet are illustrated. The opposed and parallel ends 133 of the skirt 26 limit travel of the carriage 24 by contact with the outside periphery of wheels 76 illustrated in FIGS. 2 and 7.

Figure 11:
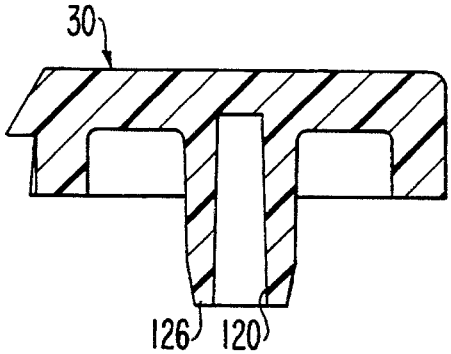
FIG. 11 illustrates a sectional view of FIG. 9 taken along section lines 11—11.

FIG. 11 illustrates a sectional view of projection 30 taken along section line 11—11 in FIG. 9.

FIG. 12 illustrates a partial sectional view of one of the spigots 120 after deformation in a spigot aperture 32 to attach the flatbed 20 to the skirt 26. Post 130 is illustrated with a rubber foot attached thereto.

FIG. 13 illustrates an exploded view of FIG. 12.

Figure 14:
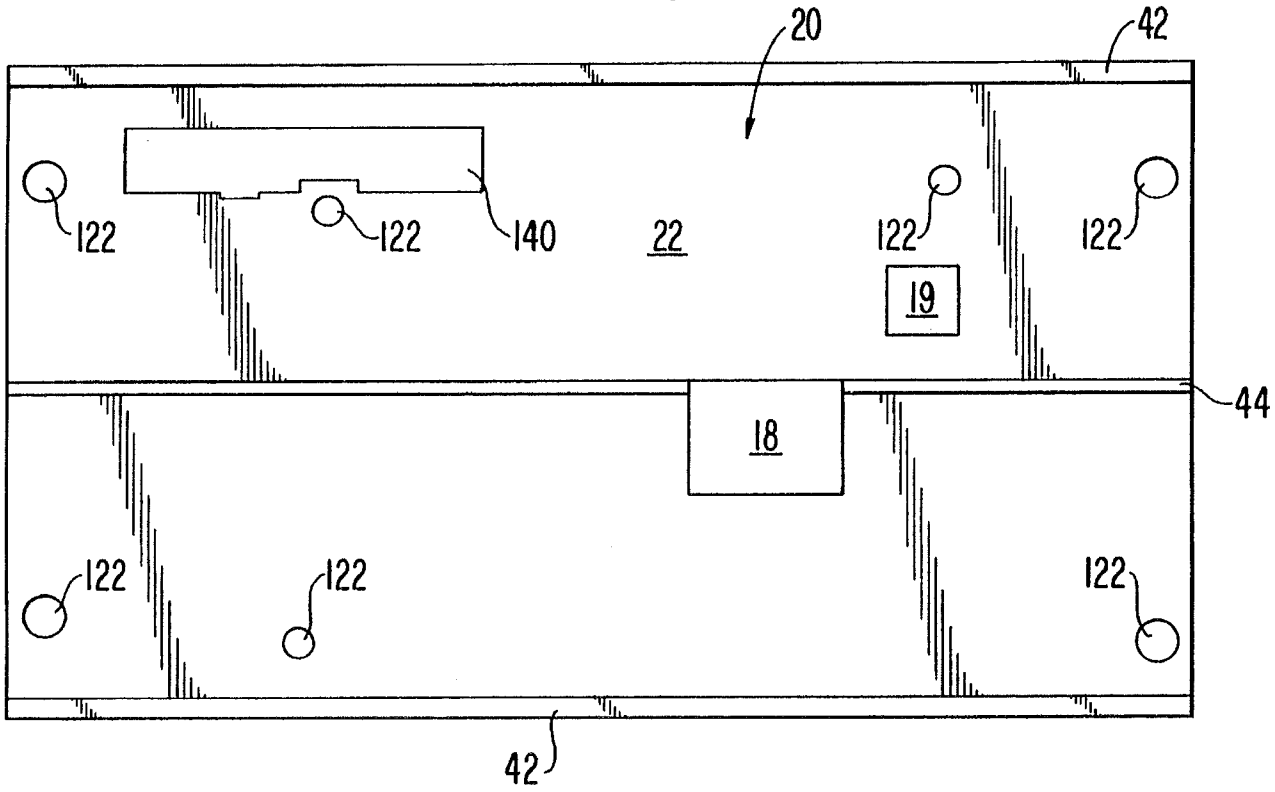
FIG. 14 illustrates a top plan view of the flatbed.

FIG. 14 illustrates a top plan view of the flatbed 20. Aperture 140 receives the mechanism 40 for preventing imprinting when the card 14 is not in place.

Figure 15:
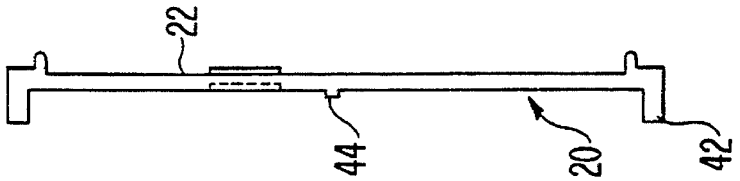
FIG. 15 illustrates an end view of the flatbed.

FIG. 15 illustrates an end view of the flatbed 20.

The method of assembling an imprinter, which imprints a formset 12 with data from the embossed card 14, the plate 16 and optional dater, having a flatbed 20 with a top surface 22 supporting the card, plate and formset and a movable carriage 24 which rolls along the flatbed during imprinting of the formset with the embossed data includes the following steps. First, a single piece skirt 26 is formed from a material which is preferably plastic, by an operation such as molding. The skirt has an inside periphery 28 for receiving the flatbed 20. The skirt has a plurality of projections 30 and 32 extending inward from the inside periphery of the skirt 26 with the first pair of projections 30 having ends separated by a length of the card 14 and the second pair of projections 32 having ends separated by a length of a formset 12. Finally, the skirt 26 is attached to the flatbed 20 to form a unitary structure with the projections 30 and 32 extending over the flatbed. The skirt 26 has a plurality of spigots 120, as illustrated in FIGS. 7 and 9, which project orthogonally from the projections 30 and 32. The skirt is attached to the flatbed 20 by deforming by swaging an end 126 of each of the spigots, as illustrated in FIG. 12, which extend through a plurality of spigot apertures 122 drilled through the flatbed 20 from the top surface 22 to the bottom surface 124 to a deformed dimension, as illustrated in FIG. 12, larger than a largest dimension of a cross section of the spigot aperture through which each spigot projects which deformed dimension contacts the bottom surface of the flatbed. Furthermore, aperture 140 is cut through the flatbed 20 from the top surface 22 to the bottom surface 124 which receives the mechanism 40 carried by one of the first pair of projections 30 which prevents the carriage 24 from being moved over the card receiving area 34 of the flatbed extending between ends of the first pair of projections. The attachment of the skirt 26 to the flatbed 20 to form a unitary structure positions the mechanism 40 in the aperture 140 through the flatbed 20. Each projection 30 and 32 has at least one spigot 120 and the end 126 of each spigot is deformed, as illustrated in FIG. 12, preferably by use of the double action press as described above.

While a preferred embodiment of the invention, as illustrated above, is a credit card imprinter, it should be understood that the present invention is not limited to credit card imprinters with the invention also having utility for other types of imprinting devices, such as, but not limited to, devices used in hospitals, where multiple page formsets are imprinted with characters embossed on one or more cards. The invention is not limited to any design of the flatbed 20 and carriage 24.

While the invention has been described in terms of its preferred embodiments, it should be understood that numerous modifications may be made thereto without departing from the spirit and scope of the invention as defined in the appended claims. It is intended that all such modifications fall within the scope of the appended claims.

I claim:

1. An imprinter for use in imprinting a formset with embossed data from a card and a plate comprising:

a flatbed having a top surface for supporting the card, plate and formset during imprinting with the formset being disposed above the card and the plate during imprinting;

a movable carriage having at least one rolling platen with the at least one rolling platen imprinting the embossed data during movement along the flatbed; and a single piece skirt having a periphery which extends peripherally outside the flatbed which is attached to the flatbed to form a unitary structure of the flatbed and skirt with the skirt having a plurality of projections extending onto the top surface of the flatbed with the projections defining a card receiving surface area on the top surface of the flatbed for holding the card during imprinting and a formset receiving surface area on the top surface of the flatbed for holding the formset during imprinting.

2. An imprinter in accordance with claim 1 wherein:

the flatbed has four corners;

the skirt has opposed ends; and four posts are formed in the single piece skirt which respectively receive feet to support the imprinter on a flat surface during imprinting, the four posts being located respectively at the corners of the flatbed with the opposed ends of the skirt stopping travel of the carriage during movement along the flatbed to the opposed ends.

3. An imprinter in accordance with claim 2 wherein:

the flatbed has spigot apertures extending through the flatbed from the top surface to a bottom surface;

the skirt has a plurality of spigots, each spigot projecting through the spigot apertures from the top surface to a bottom surface and having a spigot end and the skirt is attached to the flatbed by the spigot end of each of the spigots which is deformed and contacts the bottom surface with the deformed spigot end having a deformed dimension larger than a largest dimension of a cross-section of the aperture through which the spigot projects.

4. An imprinter in accordance with claim 2 wherein:

the skirt has opposed ends;

a first pair of the projections extend inward over the top surface of the flatbed from the opposed ends of the skirt with ends of the first pair of projections being separated on the top surface of the flatbed by a length of the card; and a second pair of the projections extend inward over the top surface of the flatbed from the opposed ends of the skirt with ends of the second pair of projections being separated on the top surface of the flatbed by a length of the formset.

5. An imprinter in accordance with claim 4 wherein:

a mechanism attached to one of the first pair of projections which prevents the carriage from being moved over the card receiving surface area when a card is not positioned on the top surface of the flatbed at the card receiving area; and wherein the flatbed has an aperture which extends from the top surface to the bottom surface and which receives the mechanism.

6. An imprinter in accordance with claim 3 wherein:

the skirt has opposed ends;

a first pair of the projections extend inward over the top surface of the flatbed from the opposed ends of the skirt with ends of the first pair of projections being separated on the top surface of the flatbed by a length of the card; and a second pair of the projections extend inward over the top surface of the flatbed from the opposed ends of the skirt with ends of the second pair of projections being separated on the top surface of the flatbed by a length of the formset.

7. An imprinter in accordance with claim 6 wherein:

a mechanism attached to one of the first pair of projections which prevents the carriage from being moved over the card receiving surface area when a card is not positioned on the top surface of the flatbed at the card receiving area; and wherein the flatbed has another aperture which extends from the top surface to the bottom surface and which receives the mechanism.

8. An imprinter in accordance with claim 2 wherein:

the flatbed has a pair of spaced apart rails, opposed sides and a bottom surface;

the skirt has opposed and spaced apart sides;

the carriage has a pair of downwardly extending sides with each downwardly extending side having an outside surface;

the carriage has two sets of wheels for rotatably supporting the carriage for movement along the flatbed, each set of wheels having an upper wheel which rolls in contact with one of the pair of spaced apart rails respectively located along the opposed sides of the flatbed with the rails extending above the top surface of the flatbed and a pair of lower wheels which ride on the bottom surface of the flatbed;

the pair of opposed and spaced apart sides of the skirt are respectively spaced from the outside surface of the pair of downwardly extending sides of the carriage with the spaced apart sides of the skirt and the opposed sides of the flatbed defining a pair of slots along which the downwardly extending sides of the carriage respectively carrying the first and second sets of wheels move during movement of the carriage along the flatbed; and the projections project inward from the skirt over the flatbed in a direction parallel to the pair of rails.

9. An imprinter in accordance with claim 3 wherein:

the flatbed has a pair of spaced apart rails, opposed sides and a bottom surface;

the skirt has opposed and spaced apart sides;

the carriage has a pair of downwardly extending sides with each downwardly extending side having an outside surface;

the carriage has two sets of wheels for rotatably supporting the carriage for movement along the flatbed, each set of wheels having an upper wheel which rolls in contact with one of the pair of spaced apart rails respectively located along the opposed sides of the flatbed with the rails extending above the top surface of the flatbed and a pair of lower wheels which ride on the bottom surface of the flatbed;

the pair of opposed and spaced apart sides of the skirt are respectively spaced from the outside surface of the pair of downwardly extending sides of the carriage with the spaced apart sides of the skirt and the opposed sides of the flatbed defining a pair of slots along which the downwardly extending sides of the carriage respectively carrying the first and second sets of wheels move during movement of the carriage along the flatbed; and the projections project inward from the skirt over the flatbed in a direction parallel to the pair of rails.

10. An imprinter in accordance with claim 4 wherein:

the flatbed has a pair of spaced apart rails, opposed sides and a bottom surface;

the skirt has opposed and spaced apart sides;

the carriage has a pair of downwardly extending sides with each downwardly extending side having an outside surface;

the carriage has two sets of wheels for rotatably supporting the carriage for movement along the flatbed, each set of wheels having an upper wheel which rolls in contact with one of the pair of spaced apart rails respectively located along the opposed sides of the flatbed with the rails extending above the top surface of the flatbed and a pair of lower wheels which ride on the bottom surface of the flatbed;

the pair of opposed and spaced apart sides of the skirt are respectively spaced from the outside surface of the pair of downwardly extending sides of the carriage with the spaced apart sides of the skirt and the opposed sides of the flatbed defining a pair of slots along which the downwardly extending sides of the carriage respectively carrying the first and second sets of Wheels move during movement of the carriage along the flatbed; and the projections project inward from the skirt over the flatbed in a direction parallel to the pair of rails.

11. An imprinter in accordance with claim 5 wherein:

the flatbed has a pair of spaced apart rails, opposed sides and a bottom surface;

the skirt has opposed and spaced apart sides;

the carriage has a pair of downwardly extending sides with each downwardly extending side having an outside surface;

the carriage has two sets of wheels for rotatably supporting the carriage for movement along the flatbed, each set of wheels having an upper wheel which rolls in contact with one of the pair of spaced apart rails respectively located along the opposed sides of the flatbed with the rails extending above the top surface of the flatbed and a pair of lower wheels which ride on the bottom surface of the flatbed;

the pair of opposed and spaced apart sides of the skirt are respectively spaced from the outside surface of the pair of downwardly extending sides of the carriage with the spaced apart sides of the skirt and the opposed sides of the flatbed defining a pair of slots along which the downwardly extending sides of the carriage respectively carrying the first and second sets of wheels move during movement of the carriage along the flatbed; and the projections project inward from the skirt over the flatbed in a direction parallel to the pair of rails.

12. An imprinter in accordance with claim 6 wherein:

the flatbed has a pair of spaced apart rails, opposed sides and a bottom surface;

the skirt has opposed and spaced apart sides;

the carriage has a pair of downwardly extending sides with each downwardly extending side having an outside surface;

the carriage has two sets of wheels for rotatably supporting the carriage for movement along the flatbed, each set of wheels having an upper wheel which rolls in contact with one of the pair of spaced apart rails respectively located along the opposed sides of the flatbed with the rails extending above the top surface of the flatbed and a pair of lower wheels which ride on the bottom surface of the flatbed;

the pair of opposed and spaced apart sides of the skirt are respectively spaced from the outside surface of the pair of downwardly extending sides of the carriage with the spaced apart sides of the skirt and the opposed sides of the flatbed defining a pair of slots along which the downwardly extending sides of the carriage respectively carrying the first and second sets of wheels move during movement of the carriage along the flatbed; and the projections project inward from the skirt over the flatbed in a direction parallel to the pair of rails.

13. An imprinter in accordance with claim 7 wherein:

the flatbed has a pair of spaced apart rails, opposed sides and a bottom surface;

the skirt has opposed and spaced apart sides;

the carriage has a pair of downwardly extending sides with each downwardly extending side having an outside surface;

the carriage has two sets of wheels for rotatably supporting the carriage for movement along the flatbed, each set of wheels having an upper wheel which rolls in contact with one of the pair of spaced apart rails respectively located along the opposed sides of the flatbed with the rails extending above the top surface of the flatbed and a pair of lower wheels which ride on the bottom surface of the flatbed;

the pair of opposed and spaced apart sides of the skirt are respectively spaced from the outside surface of the pair of downwardly extending sides of the carriage with the spaced apart sides of the skirt and the opposed sides of the flatbed defining a pair of slots along which the downwardly extending sides of the carriage respectively carrying the first and second sets of wheels move during movement of the carriage along the flatbed; and the projections project inward from the skirt over the flatbed in a direction parallel to the pair of rails.

14. An imprinter in accordance with claim 1 wherein:

the flatbed has spigot apertures extending through the flatbed from the top surface to a bottom surface;

the skirt has a plurality of spigots, each spigot projecting through the spigot apertures from the top surface to a bottom surface and having a spigot end and the skirt is attached to the flatbed by the spigot end of each of the spigots which is deformed and contacts the bottom surface with the deformed spigot end having a deformed dimension larger than a largest dimension of a cross-section of the aperture through which the spigot projects.

15. An imprinter in accordance with claim 14 wherein:

the skirt has opposed ends;

a first pair of the projections extend inward over the top surface of the flatbed from the opposed ends of the skirt with ends of the first pair of projections being separated on the top surface of the flatbed by a length of the card; and a second pair of the projections extend inward over the top surface of the flatbed from the opposed ends of the skirt with ends of the second pair of projections being separated on the top surface of the flatbed by a length of the formset.

16. An imprinter in accordance with claim 15 wherein:

a mechanism attached to one of the first pair of projections which prevents the carriage from being moved over the card receiving surface area when a card is not positioned on the top surface of the flatbed at the card receiving area; and wherein the flatbed has another aperture which extends from the top surface to the bottom surface and which receives the mechanism.

17. An imprinter in accordance with claim 14 wherein:

the flatbed has a pair of spaced apart rails, opposed sides and a bottom surface;

the skirt has opposed and spaced apart sides;

the carriage has a pair of downwardly extending sides with each downwardly extending side having an outside surface;

the carriage has two sets of wheels for rotatably supporting the carriage for movement along the flatbed, each set of wheels having an upper wheel which rolls in contact with one of the pair of spaced apart rails respectively located along the opposed sides of the flatbed with the rails extending above the top surface of the flatbed and a pair of lower wheels which ride on the bottom surface of the flatbed;

the pair of opposed and spaced apart sides of the skirt are respectively spaced from the outside surface of the pair of downwardly extending sides of the carriage with the spaced apart sides of the skirt and the opposed sides of the flatbed defining a pair of slots along which the downwardly extending sides of the carriage respectively carrying the first and second sets of wheels move during movement of the carriage along the flatbed; and the projections project inward from the skirt over the flatbed in a direction parallel to the pair of rails.

18. An imprinter in accordance with claim 15 wherein:

the flatbed has a pair of spaced apart rails, opposed sides and a bottom surface.;

the skirt has opposed and spaced apart sides;

the carriage has a pair of downwardly extending sides with each downwardly extending side having an outside surface;

the carriage has two sets of wheels for rotatably supporting the carriage for movement along the flatbed, each set of wheels having an upper wheel which rolls in contact with one of the pair of spaced apart rails respectively located along the opposed sides of the flatbed with the rails extending above the top surface of the flatbed and a pair of lower wheels which ride on the bottom surface of the flatbed;

the pair of opposed and spaced apart sides of the skirt are respectively spaced from the outside surface of the pair of downwardly extending sides of the carriage with the spaced apart sides of the skirt and the opposed sides of the flatbed defining a pair of slots along which the downwardly extending sides of the carriage respectively carrying the first and second sets of wheels move during movement of the carriage along the flatbed; and the projections project inward from the skirt over the flatbed in a direction parallel to the pair of rails.

19. An imprinter in accordance with claim 16 wherein:

the flatbed has a pair of spaced apart rails, opposed sides and a bottom surface;

the skirt has opposed and spaced apart sides;

the carriage has a pair of downwardly extending sides with each downwardly extending side having an outside surface;

the carriage has two sets of wheels for rotatably supporting the carriage for movement along the flatbed, each set of wheels having an upper wheel which rolls in contact with one of the pair of spaced apart rails respectively located along the opposed sides of the flatbed with the rails extending above the top surface of the flatbed and a pair of lower wheels which ride on the bottom surface of the flatbed;

the pair of opposed and spaced apart sides of the skirt are respectively spaced from the outside surface of the pair of downwardly extending sides of the carriage with the spaced apart sides of the skirt and the opposed sides of the flatbed defining a pair of slots along which the downwardly extending sides of the carriage respectively carrying the first and second sets of wheels move during movement of the carriage along the flatbed; and the projections project inward from the skirt over the flatbed in a direction parallel to the pair of rails.

20. An imprinter in accordance with claim 1 wherein:

the skirt has opposed ends;

a first pair of the projections extend inward over the top surface of the flatbed from the opposed ends of the skirt with ends of the first pair of projections being separated on the top surface of the flatbed by a length of the card; and a second pair of the projections extend inward over the top surface of the flatbed from the opposed ends of the skirt with ends of the second pair of projections being separated on the top surface of the flatbed by a length of the formset.

21. An imprinter in accordance with claim 20 further comprising:

a mechanism attached to one of the first pair of projections which prevents the carriage from being moved over the card receiving surface area when a card is not positioned on the top surface of the flatbed at the card receiving area; and wherein the flatbed has an aperture which extends from the top surface to the bottom surface and which receives the mechanism.

22. An imprinter in accordance with claim 20 wherein:

the flatbed has a pair of spaced apart rails, opposed sides and a bottom surface;

the skirt has opposed and spaced apart sides;

the carriage has a pair of downwardly extending sides with each downwardly extending side having an outside surface;

the carriage has two sets of wheels for rotatably supporting the carriage for movement along the flatbed, each set of wheels having an upper wheel which rolls in contact with one of the pair of spaced apart rails respectively located along the opposed sides of the flatbed with the rails extending above the top surface of the flatbed and a pair of lower wheels which ride on the bottom surface of the flatbed;

the pair of opposed and spaced apart sides of the skirt are respectively spaced from the outside surface of the pair of downwardly extending sides of the carriage with the spaced apart sides of the skirt and the opposed sides of the flatbed defining a pair of slots along which the downwardly extending sides of the carriage respectively carrying the first and second sets of wheels move during movement of the carriage along the flatbed; and the projections project inward from the skirt over the flatbed in a direction parallel to the pair of rails.

23. An imprinter in accordance with claim 21 wherein:

the flatbed has a pair of spaced apart rails, opposed sides and a bottom surface;

the skirt has opposed and spaced apart sides;

the carriage has a pair of downwardly extending sides with each downwardly extending side having an outside surface;

the carriage has two sets of wheels for rotatably supporting the carriage for movement along the flatbed, each set of wheels having an upper wheel which rolls in contact with one of the pair of spaced apart rails respectively located along the opposed sides of the flatbed with the rails extending above the top surface of the flatbed and a pair of lower wheels which ride on the bottom surface of the flatbed;

the pair of opposed and spaced apart sides of the skirt are respectively spaced from the outside surface of the pair of downwardly extending sides of the carriage with the spaced apart sides of the skirt and the opposed sides of the flatbed defining a pair of slots along which the downwardly extending sides of the carriage respectively carrying the first and second sets of wheels move during movement of the carriage along the flatbed; and the projections project inward from the skirt over the flatbed in a direction parallel to the pair of rails.

24. An imprinter in accordance with claim 1 wherein:

the flatbed has a pair of spaced apart rails, opposed sides and a bottom surface;

the skirt has opposed and spaced apart sides;

the carriage has a pair of downwardly extending sides with each downwardly extending side having an outside surface;

the carriage has two sets of wheels for rotatably supporting the carriage for movement along the flatbed, each set of wheels having an upper wheel which rolls in contact with one of the pair of spaced apart rails respectively located along the opposed sides of the flatbed with the rails extending above the top surface of the flatbed and a pair of lower wheels which ride on the bottom surface of the flatbed;

the pair of opposed and spaced apart sides of the skirt are respectively spaced from the outside surface of the pair of downwardly extending sides of the carriage with the spaced apart sides of the skirt and the opposed sides of the flatbed defining a pair of slots along which the downwardly extending sides of the carriage respectively carrying the first and second sets of wheels move during movement of the carriage along the flatbed; and the projections project inward from the skirt over the flatbed in a direction parallel to the pair of rails.

25. A method of assembling an imprinter, for use in imprinting a formset with data from an embossed card and a plate, having a flatbed with a top surface supporting the card, plate and formset during imprinting and a moveable carriage which rolls along the flatbed during imprinting of the formset with the data comprising:

forming a single piece skirt including a plurality of projections and having an inside periphery for receiving the flatbed with the skirt having the plurality of projections extending inward from the skirt with a first pair of the projections having ends separated over the top surface of the flatbed by distance equal to a length of the card and a second pair of the projections having ends separated over the top surface of the flatbed by a length of the formset; and attaching the skirt to the flatbed to form a unitary structure.

26. A method in accordance with claim 25 further comprising:

forming the skirt with a plurality of spigots which project orthogonally from the projections with each spigot having an end;

cutting a plurality of spigot apertures through the flatbed from a top surface to a bottom surface;

positioning the spigots to extend through the spigot apertures; and the deforming of the end of each of the spigots which extends through one of the plurality of spigot apertures is to a deformed dimension which contacts the bottom surface and which is larger than a largest dimension of a cross section of the spigot aperture through which each spigot projects.

27. A method in accordance with claim 26 further comprising:

cutting an aperture through the flatbed from the top surface to a bottom surface; and wherein the skirt is attached to the flatbed to form the unitary structure with attachment of the skirt to the flatbed positioning a mechanism, attached to one of the first pair of projections for preventing the carriage from being moved over a card receiving area of the top surface of the flatbed extending between ends of the first pair of projections, in the aperture through the flatbed.

28. A method in accordance with claim 27 further comprising:

each projection has one spigot; and the positioning of the spigots to extend through the spigot apertures includes positioning a spigot of each projection to extend through one of the spigot apertures.

29. A method in accordance with claim 25 further comprising:

cutting an aperture through the flatbed from the top surface to a bottom surface; and wherein the skirt is attached to the flatbed to form the unitary structure with attachment of the skirt to the flatbed positioning a mechanism, attached to one of the first pair of projections for preventing the carriage from being moved over a card receiving area of the top surface of the flatbed extending between ends of the first pair of projections, in the aperture through the flatbed.

30. A method in accordance with claim 26 further comprising:

each projection has one spigot; and the positioning of the spigots to extend through the spigot apertures includes positioning a spigot of each projection to extend through one of the spigot apertures.

* * * * *